US005254180A

United States Patent [19]

Bonner et al.

[11] Patent Number: 5,254,180

[45] Date of Patent: Oct. 19, 1993

[54] ANNEALING OF CARBON STEELS IN A PRE-HEATED MIXED AMBIENTS OF NITROGEN, OXYGEN, MOISTURE AND REDUCING GAS

[75] Inventors: Brian B. Bonner, Nesquehoning; Diwakar Garg, Macungie, both of Pa.

[73] Assignee: Air Products and Chemicals, Inc., Allentown, Pa.

[21] Appl. No.: 995,611

[22] Filed: Dec. 22, 1992

[51] Int. Cl.[5] ..... C21D 1/00

[52] U.S. Cl. ..... 148/208; 148/206; 266/81

[58] Field of Search ..... 148/206, 208; 266/81

[56] References Cited

U.S. PATENT DOCUMENTS 4,713,124 12/1987 Schmetz et al. ..... 148/559
5,069,728 12/1991 Rancon et al. ..... 266/81

OTHER PUBLICATIONS

Stratton, P. F., Heat Treatment of Metals, 3 (1989) 63-67.

*Primary Examiner*—Upendra Roy
*Attorney, Agent, or Firm*—James C. Simmons; William F. Marsh

[57] ABSTRACT

An improved process for producing high-moisture containing nitrogen-based atmospheres suitable for oxide and decarburize annealing of carbon steels from non-cryogenically generated nitrogen is presented. These nitrogen-based atmospheres are produced by 1) mixing non-cryogenically generated nitrogen containing less than 5.0 vol. % residual oxygen with a specified amount of hydrogen, 2) humidifying the gaseous feed mixture, 3) feeding the gaseous mixture into the heating zone of a furnace through a diffuser, and 4) converting in-situ the residual oxygen present in it to moisture. According to the present invention, the total amount of hydrogen required for producing suitable atmospheres can be minimized by simultaneously humidifying the feed gas and controlling the residual oxygen level in it. The key features of the present invention include a) humidifying the feed gas prior to introducing it into the heating zone of a furnace operated above about 600° C., b) selecting the level of residual oxygen in the feed gas in such a way that it minimizes hydrogen consumption, and c) using enough amount of hydrogen to convert completely the residual oxygen present in the feed gas to moisture and to maintain $pH_2/pH_2O$ ratio in the heating zone of the furnace below about 2 for oxide annealing and at least 2 for decarburize annealing carbon steels.

9 Claims, 3 Drawing Sheets

ANNEALING OF CARBON STEELS IN A PRE-HEATED MIXED AMBIENTS OF NITROGEN, OXYGEN, MOISTURE AND REDUCING GAS

FIELD OF THE INVENTION

The present pertains to processes for oxide and decarburize annealing carbon steels using noncryogenically generated nitrogen.

BACKGROUND OF INVENTION

U.S. patent application Ser. No. 07/727,806, filed Jul. 8, 1991, discloses a process for producing in-situ heat treating atmospheres from non-cryogenically generated nitrogen. According to this patent application, suitable atmospheres are produced by 1) mixing non-cryogenically generated nitrogen containing up to 5 vol. % residual oxygen with a reducing gas such as hydrogen, 2) feeding the gaseous mixture into a furnace in a specified manner to effect conversion of the residual oxygen to an acceptable form such as moisture. The flow rate of hydrogen according to the application is controlled in such way so that it is always greater than the stoichiometric amount of hydrogen required for the complete conversion of residual oxygen to moisture. Specifically, the flow rate of hydrogen for oxide annealing is controlled between 1.1 times to 1.5 times the stoichiometric amount. Likewise, the flow rate of hydrogen for decarburize, bright annealing is controlled to be at least 3.0 times the stoichiometric amount.

The residual oxygen present in non-cryogenically generated nitrogen is reacted with hydrogen and converted to moisture following the equation:

$$2H_2+O_2 \rightarrow 2H_2O$$

According to this equation, two moles (or parts) of hydrogen react with one mole (or part) of oxygen to yield two moles (or parts) of water or moisture. For example, 0.5 vol. % residual oxygen present in non-cryogenically generated nitrogen requires a minimum of 1.0 vol. % hydrogen to produce 1.0 vol. % moisture or nitrogen gas with approximately 45° F. dew point. One can therefore easily calculate the stoichiometric amount of hydrogen and that required for oxide and decarburize, bright annealing carbon steels knowing the level of residual oxygen in the feed gas. These values were calculated and are summarized below.

| Residual | Stoichio. Amount | Oxide Annealing | | Decarburize, Bright Annealing | |
|---|---|---|---|---|---|
| Oxygen, % | of $H_2$, % | $H_2$, % | D.P., °F. | $H_2$, % | D.P., °F. |
| 0.2 | 0.4 | 0.44 | 22 | 1.2 | 22 |
| 0.5 | 1.0 | 1.10 | 45 | 3.0 | 45 |
| 1.0 | 2.0 | 2.20 | 62 | 6.0 | 62 |
| 1.5 | 3.0 | 3.30 | 76 | 9.0 | 76 |

One can see that the stoichiometric amount of hydrogen and that required for oxide and decarburize, bright annealing carbon steels increase with the level of residual oxygen in non-cryogenically generated nitrogen.

It is well known in the literature that the thickness of an adherent, tightly packed oxide layer and the extent of decarburization of carbon steels depend on the temperature and the level of moisture present in the atmosphere. The thickness of oxide layer and the extent of decarburization increase with temperature and an increase in the moisture level in the atmosphere. Therefore, it is desirable to increase moisture level in the furnace atmosphere to produce parts with the required 1) thickness of the oxide layer and 2) level of decarburization.

According to the above patent application, if an atmosphere containing 1.0 vol. % moisture (or D.P. of 45° F.) i s required for oxide annealing carbon steels, it is produced in-situ from non-cryogenically generated nitrogen containing 0.5% residual oxygen mixed with a slightly more than a stoichiometric amount (>1.0%) of hydrogen. An atmosphere for decarburize, bright annealing carbon steels containing 1.0 vol. % moisture is produced from non-cryogenically generated nitrogen containing 0.5% residual oxygen mixed with at least 3.0% hydrogen. Likewise, if an atmosphere containing 3.0 vol. % moisture (or D.P. of 76° F.) is required for oxide annealing carbon steels, it is produced in-situ from non-cryogenically generated nitrogen containing 1.5% residual oxygen mixed with a slightly more than stoichiometric amount (>3.0%) of hydrogen. An atmosphere for decarburize, bright annealing carbon steels containing 3.0 vol. % moisture is produced from non-cryogenically generated nitrogen containing 1.5% residual oxygen mixed with at least 9.0% hydrogen. Therefore, it is clearly evident that the amount of hydrogen required for producing nitrogen-based atmospheres for oxide and decarburize, bright annealing carbon steels from non-cryogenically generated nitrogen increases with the level of residual oxygen in the feed stream. Therefore, it may not be economically feasible to produce high-moisture containing atmospheres from nitrogen feed stream with high-residual oxygen because of the excessive use of expensive hydrogen.

Based upon the above discussion, it is clear that there is a need to develop a process for producing high-moisture containing atmospheres suitable for oxide and decarburize annealing carbon steels economically from non-cryogenically generated nitrogen.

SUMMARY OF THE INVENTION

The present invention pertains to a process for producing high-moisture containing nitrogen-based atmospheres suitable for oxide and decarburize annealing carbon steels economically from non-cryogenically generated nitrogen. According to the process of the present invention, suitable atmospheres are produced by 1) mixing non-cryogenically generated nitrogen containing less than 5.0 vol. % residual oxygen with a specified amount of hydrogen, 2) humidifying the gaseous mixture, 3) feeding the gaseous mixture into the heating zone of a furnace through a diffuser, and 4) converting in-situ the residual oxygen present in the mixture to moisture. The nitrogen can be humidified prior to mixing with the hydrogen. The total amount of hydrogen required for producing suitable atmospheres is minimized by simultaneously humidifying the feed gas and controlling the residual oxygen level in it.

The critical aspects of the present invention include a) humidifying the feed gas prior to introducing it into the heating zone of a furnace operated above about 600° C., b) selecting the level of residual oxygen in the feed gas in such a way that it minimizes hydrogen consumption, and c) using enough hydrogen to completely convert the residual oxygen present in the feed gas to moisture and to maintain $pH_2/pH_2O$ ratio in the atmosphere in the heating zone of the furnace below about 2 for oxide annealing and at least 2 for decarburize annealing carbon steels.

DETAILED DESCRIPTION OF THE INVENTION

Figure 1:
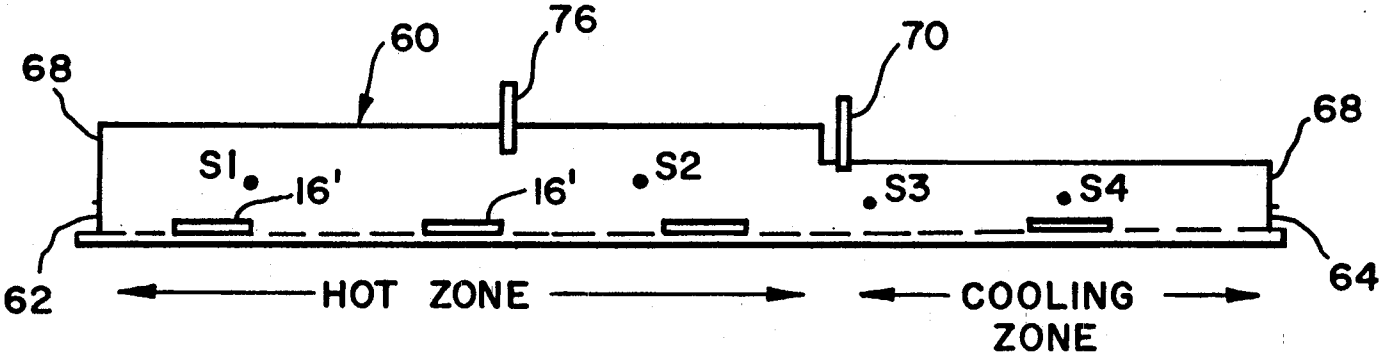
FIG. 1 is a schematic representation of a furnace used to test the heat treating process according to the present invention.

The present invention discloses a process for producing high-moisture containing atmospheres suitable for oxide and decarburize annealing carbon steels using non-cryogenically generated nitrogen. The process of the present invention is based on the discovery that atmospheres suitable for above applications can be produced economically by 1) mixing non-cryogenically generated nitrogen containing less than 5.0 vol. % residual oxygen with a specified amount of hydrogen, 2) humidifying the gaseous feed mixture, and 3) feeding the gaseous mixture into the heating zone of a furnace through a diffuser, and 4) converting in-situ the residual oxygen present in it to moisture. Optionally, the non-cryogenically generated nitrogen can be humidified before mixing with the hydrogen or simultaneously therewith. The total amount of hydrogen required for producing suitable atmospheres is minimized by simultaneously humidifying the feed gas and controlling the residual oxygen level in it.

Nitrogen gas produced by cryogenic distillation of air has been widely employed in many heat treating applications. Cryogenically produced nitrogen is substantially free of oxygen (oxygen content is generally less than 10 ppm) and expensive. Therefore, there has been a great demand, especially by the heat treating industry, to generate nitrogen safely and inexpensively for heat treating applications. With the advent of non-cryogenic technologies for air separation such as adsorption and permeation, it is now possible to produce nitrogen gas safely and inexpensively. The non-cryogenically produced nitrogen, however, is contaminated with up to 5% residual oxygen, which is generally undesirable for many heat treating applications. The presence of residual oxygen has made the direct substitution of cryogenically produced nitrogen with that produced by non-cryogenic techniques very difficult, if not impossible.

According to the present invention, high-moisture containing atmospheres are produced by 1) mixing non-cryogenically generated nitrogen containing less than 5.0 vol. % residual oxygen with a specified amount of hydrogen, 2) humidifying the gaseous feed mixture, 3) feeding the gaseous mixture into the heating zone of a furnace operated above about 600° C. in the manner taught in U.S. patent application Ser. No. 07/727,806, filed Jul. 8, 1991, the specification of which is incorporated herein by reference, and 4) converting in-situ in the furnace the residual oxygen present in the mixture to moisture. The new heretofore unknown aspects of the present invention include a) humidifying the feed gas prior to introducing it into the heating zone of a furnace operated above about 600° C., b) selecting the level of residual oxygen in the feed gas in such a way that it minimizes hydrogen consumption, and c) using enough amount of hydrogen to convert completely the residual oxygen present in the feed gas to moisture and to maintain $pH_2/pH_2O$ ratio in the atmospehre in the heating zone of the furnace below 2 for oxide annealing and and at least 2 for decarburize annealing carbon steels.

The residual oxygen in non-cryogenically produced nitrogen for the process of the present invention can vary from 0.05% to less than about 5.0 vol. %, preferably from about 0.1% to about 3.0 vol. %, and ideally from about 0.1% to about 1.0 vol. %.

The amount of hydrogen gas required for converting residual oxygen is always more than a stoichiometric amount required for converting oxygen completely to moisture. However, it is preferable to use enough hydrogen to provide a $pH_2/pH_2O$ ratio of less than 2 in the heating zone of the furnace for oxide annealing of carbon steels. The amount of hydrogen gas required for decarburize annealing carbon steels is controlled in such a way that the ratio of $pH_2/pH_2O$ in the atmosphere in the heating zone of the furnace is at least 2.

The amount of moisture added to the feed gas can vary from about 0.1 vol. % to about 5.0 vol. %. It is, however, important to adjust the hydrogen and moisture levels in the feed gas in such a way that a desired $pH_2/pH_2O$ ratio is obtained in the atmosphere in the heating and cooling zones of the furnace. The moisture added to the gaseous feed mixture to produce the desired thickness of oxide layer or the desired decarburization level can alternatively be introduced in the heating zone of the furnace in the form of water vapors or steam. A part of moisture can be replaced with known decarburizing gases such as carbon dioxide and nitrous oxide ($N_2O$).

According to the present invention, the residual oxygen is converted with hydrogen to moisture in the heating zone of a heat treating furnace by introducing the gaseous feed mixture through a device that prevents the direct impingement of feed gas on the parts in accord with the teaching of U.S. patent application Ser. No. 07/727,806. A particularly effective device is shown in FIG. 3C of the Application disposed horizontally in the furnace between the parts being treated and the top or roof of the furnace.

In addition to using devices discussed above, a flow directing plate or a device facilitating mixing of hot gases present in the furnace with the feed gas can also be used.

The design and dimensions of the device will depend upon the size of the furnace, the operating temperature, and the total flow rate of the feed used during heat treatment. More than one device can be used to introduce gaseous feed mixture in the hot zone of a continuous furnace depending upon the size of the furnace and the total flow rate of feed gas.

A furnace equipped with separate heating and cooling zones is most suitable for the process of the invention. It can be operated at atmospheric or above atmospheric pressure for the process of the invention. The furnace can be of the mesh belt, a roller hearth, a pusher tray, a walking beam, or a rotary hearth type. The furnace should have the capability of introducing steam or a non-cryogenically generated nitrogen stream in the cooling zone at a temperature below about 550° C. to oxidize parts in a controlled manner, if required. The furnace can optionally be equipped with a nitrogen gas (containing less than 10 ppm oxygen) curtain at the end of the cooling zone (discharge end) to avoid infiltration of air from the outside through the discharge vestibule.

The operating temperature of the heat treating furnace can be selected from about 600° C. to about 950° C.

Low to high carbon or alloy steels that can be heat treated according to the present invention can be selected from the groups 10XX, 11XX, 12XX, 13XX, 15XX, 40XX, 41XX, 43XX, 44XX, 47XX, 48XX, 50XX, 51XX, 61XX, 81XX, 86XX, 87XX, 88XX, 92XX, 92XX, 93XX, 50XXX, 51XXX, or 52XXX as described in Metals Handbook, Ninth Edition, Volume 4 Heat Treating, published by American Society for Metals.

According to one embodiment of the present invention, a nitrogen-based atmosphere containing X vol. % moisture required for oxide annealing carbon steel is produced by 1) mixing nitrogen containing Y vol. % residual oxygen with slightly more than 2Y vol. % hydrogen, 2) humidifying the feed gas with (X-2Y) vol. % moisture, 3) feeding the resultant gaseous mixture into the heating zone of a furnace through a diffuser in accord with the teaching of the above referenced application, and 4) converting the residual oxygen present in it to moisture and producing the desired $pH_2/pH_2O$ ratio of less than 2 in the atmosphere in the heating zone of the furnace. For example, a nitrogen-based atmosphere containing 3.0 vol. % moisture required for oxide annealing carbon steels is produced from non-cryogenically generated nitrogen containing 0.5 vol. % residual oxygen by using slightly more than 1.0% hydrogen and 2.0% moisture. This represents a saving of more than 2.0% hydrogen over the amount that will be required with non-cryogenically generated nitrogen containing 1.5 vol. % residual oxygen.

According to another embodiment of the present invention, a nitrogen-based atmosphere containing X vol. % moisture required to decarburize, bright anneal carbon steels is produced by 1) mixing nitrogen containing Y vol. % residual oxygen with slightly more than (2X+2Y) vol. % hydrogen, 2) humidifying the feed gas with (X−2Y) vol. % moisture, 3) feeding the resultant gaseous feed mixture into the heating zone of a furnace through a diffuser, and 4) converting the residual oxygen present in it to moisture and producing the desired $pH_2/pH_2O$ ratio of at least 2 in the atmosphere in the heating and cooling zones of the furnace. For example, a nitrogen-based atmosphere containing 3.0 vol. % moisture required for decarburize, bright annealing carbon steels is produced from non-cryogenically generated nitrogen containing 0.5 vol. % residual oxygen by using slightly more than 7.0% hydrogen and 2.0% moisture. This represents a saving of more than 2.0% hydrogen over the amount that will be required with non-cryogenically produced nitrogen containing 1.5 vol. % residual oxygen.

According to another embodiment of the present invention, a nitrogen-based atmosphere containing X vol. % moisture required decarburize, oxide annealing carbon steels is produced by 1) mixing nitrogen containing Y vol. % residual oxygen with slightly more than (2X+2Y) vol. % hydrogen, 2) humidifying the feed gas with (X−2Y) vol. % moisture, 3) feeding the resultant gaseous mixture into the heating zone of a furnace through a diffuser, and 4) converting the residual oxygen present in it to moisture and producing the desired $pH_2/pH_2O$ ratio of at least 2 in the atmosphere in heating zone of the furnace. The decarburized parts are oxidized in a controlled manner by 1) injecting steam or non-cryogenically generated nitrogen or both at temperatures below about 550° C. in the cooling zone of the furnace or by 2) discharging parts in ambient air from the cooling zone at a temperature below about 400° C. Therefore, a nitrogen-based atmosphere containing 3.0 vol. % moisture required for decarburize, oxide annealing carbon steels is produced from non-cryogenically generated nitrogen containing 0.5 vol. % residual oxygen by 1) using slightly more than 7.0% hydrogen and 2.0% moisture. This represents a saving of more than 2.0% hydrogen over the amount that will be required with non-cryogenically produced nitrogen containing 1.5 vol. % residual oxygen.

Figure 2A:
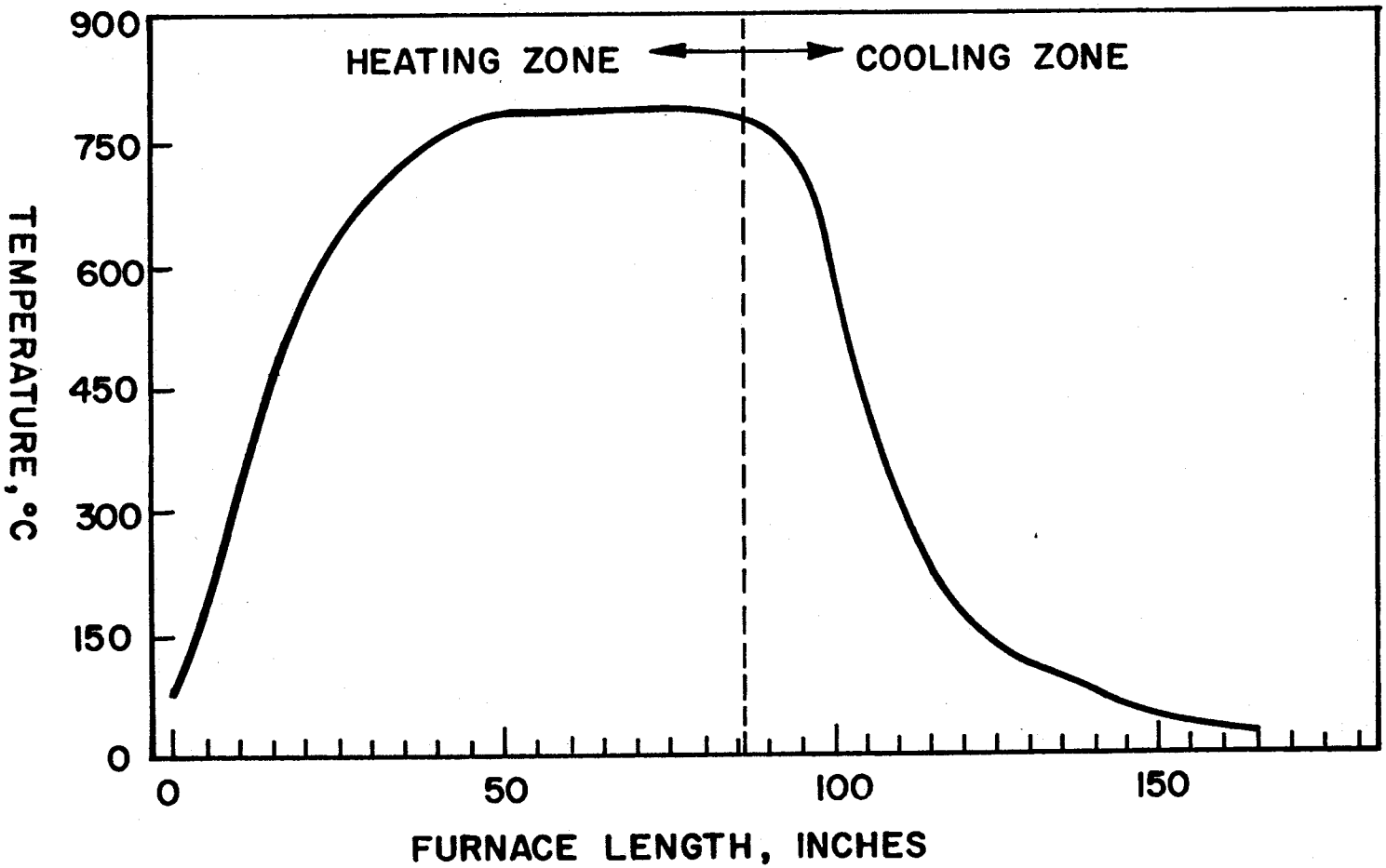
FIG. 2A is a plot of temperature against length of the furnace illustrating the experimental furnace profile for a heat treating temperature of 750° C.
Figure 2B:
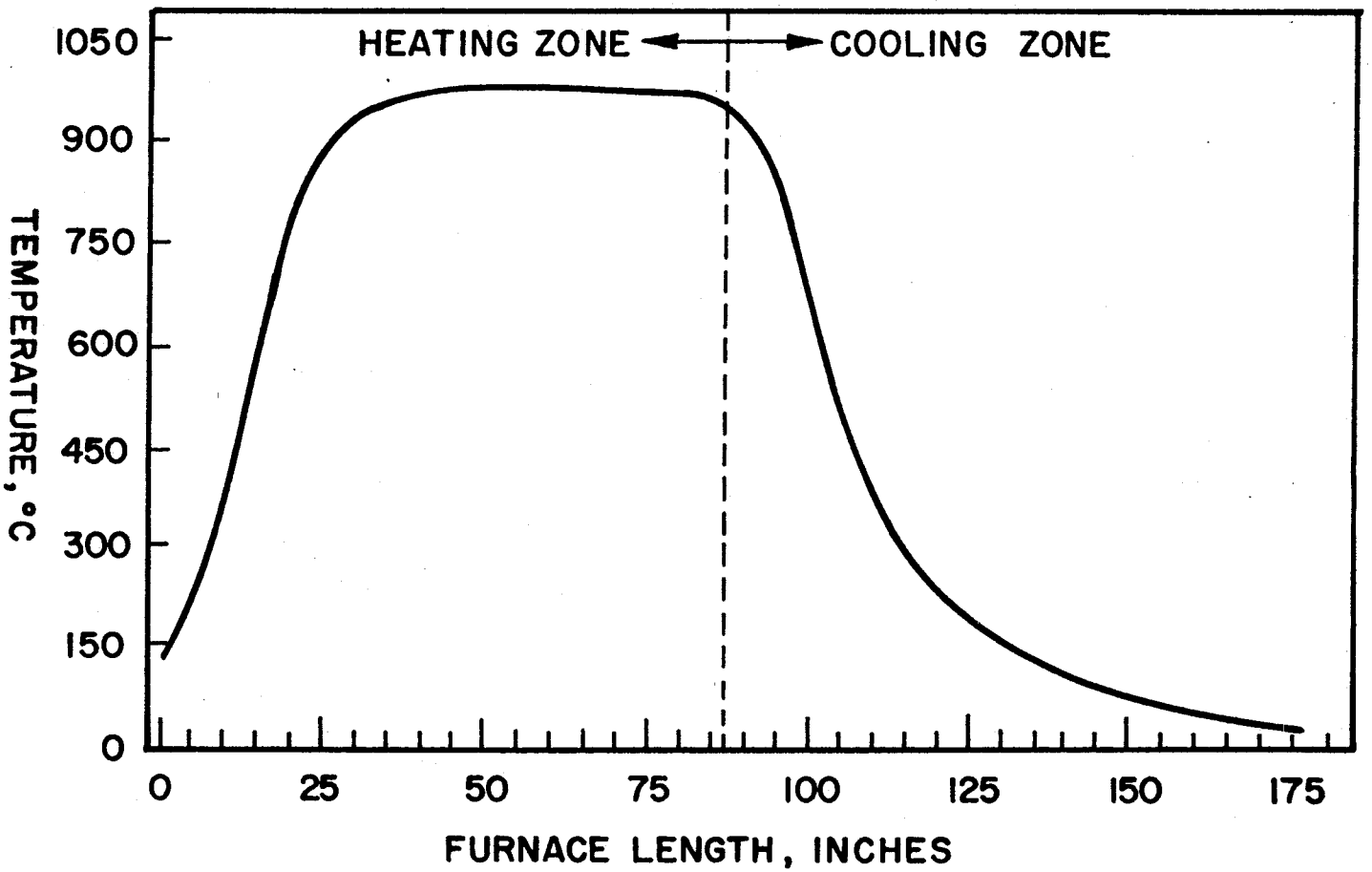
FIG. 2B is a plot similar to that of FIG. 2A for a heat treating temperature of 95° C.

A Watkins-Johnson conveyor belt furnace capable of operating up to a temperature of 1,150° C. was used in the heat treating experiments for the present invention. The heating zone of the furnace consisted of 8.75 inches wide, about 4.9 inches high, and 86 inches long Inconel 601 muffle heated resistively from the outside. The cooling zone, made of stainless steel, was 8.75 inches wide, 3.5 inches high, and 90 inches long and was water cooled from the outside. A 8.25 inches wide flexible conveyor belt supported on the floor of the furnace was used to feed the samples to be heat treated through the heating and cooling zones of the furnace. A fixed belt speed of 6 inches per minute was used in all the experiments. The furnace shown schematically as 60 in FIG. 1 was equipped with physical curtains 62 and 64 both on entry 66 and exit 68 sections to prevent air from entering the furnace. The gaseous feed mixture was introduced into the heating zone through various devices shown in the aforementioned patent application placed at location 76 in the heating zone of the furnace during heat treating experiments. The feeding area 76 was located in the heating zone 40 in. away from the cooling zone, as shown in FIG. 1. This feed area was located well into the hottest section of the heating zone as shown by the furnace temperature profiles depicted in FIGS. 2A and 2B obtained at 750° C. and 950° C. respectively, normal furnace operating temperature with 350 SCFH of pure nitrogen flowing into furnace 60. The temperature profiles show a rapid cooling of the parts as they move out of the heating zone and enter the cooling zone. Rapid cooling of the parts is commonly used by the heat treating industry to help in minimizing/preventing oxidation of the parts from high levels of moisture in the cooling zone.

In order to demonstrate the invention a series of annealing tests were carried out in the Watkins-Johnson conveyor belt furnace. An annealing temperature between 700° C. to 950° C. was selected and used for annealing 0.2 in. thick flat low-carbon steel (1010 carbon steel) specimens approximately 8 in. long by 2 in. wide. the results of these tests are summarized in Table 1 and the following discussion presented below.

TABLE 1

| | Example 1A | Example 1B | Example 1C | Example 1D | Example 1E | Example 1F |
|---|---|---|---|---|---|---|
| Type of Samples | Carbon Steel | Carbon Steel | Carbon Steel | Carbon Steel | Carbon Steel | Carbon Steel |
| Heat Treating Temperature, °C. | 750 | 750 | 750 | 750 | 950 | 950 |
| Flow Rate of Feed Gas, SCFH | 350 | 350 | 350 | 350 | 350 | 350 |
| Feed Gas Location | Heating Zone | Heating Zone | Heating Zone | Heating Zone | Heating Zone | Heating Zone |

TABLE 1-continued

| | Example 1A | Example 1B | Example 1C | Example 1D | Example 1E | Example 1F |
|---|---|---|---|---|---|---|
| Type of Feed Device | Modified Diffuser | Modified Diffuser | Modified Diffuser | Modified Diffuser | Modified Diffuser | Modified Diffuser |
| Feed Gas Composition | | | | | | |
| Nitrogen, % | 99.5 | 99.5 | 99.5 | 99.5 | 99.5 | 99.5 |
| Oxygen, % | 0.5 | 0.5 | 0.5 | 0.5 | 0.5 | 0.5 |
| Moisture, % | 0.0 | 0.0 | 0.0 | 0.0 | 0.0 | 0.0 |
| Hydrogen*, % | 1.2 | 1.5 | 3.0 | 5.0 | 1.2 | 5.0 |
| Heating Zone Atmosphere Composition | | | | | | |
| Oxygen, ppm | <4 | <3 | <3 | <3 | <3 | <2 |
| Hydrogen, % | 0.2 | 0.5 | 2.0 | 4.0 | 0.2 | 4.0 |
| Moisture, % | 1.0 | 1.0 | 1.0 | 1.0 | 1.0 | 1.0 |
| Cooling Zone Atmosphere Composition | | | | | | |
| Oxygen, ppm | <4 | <3 | <4 | <2 | <3 | <1 |
| Hydrogen, % | 0.2 | 0.5 | 2.0 | 4.0 | 0.2 | 4.0 |
| Moisture, % | 1.0 | 1.0 | 1.0 | 1.0 | 1.0 | 1.0 |
| $pH_2/pH_2O$ Ratio in the Furnace | 0.2 | 0.5 | 2.0 | 4.0 | 0.2 | 4.0 |
| Quality of Heat Treated Sample | Uniform Tightly Packed Oxide | Uniform Tightly Packed Oxide | Uniform Shiny Bright | Uniform Shiny Bright | Uniform Tightly Packed Oxide | Uniform Shiny Bright |

*Hydrogen gas was mixed with nitrogen and added as a percent of total non-cryogenically produced feed nitrogen.

EXAMPLE 1A

Samples of carbon steel were annealed at 750° C. in the Watkins-Johnson furnace using 350 SCFH of nitrogen containing 99.5% nitrogen and 0.5% oxygen. The gaseous feed mixture was mixed with 1.2% hydrogen, which was 1.2 times the stoichiometric amount required for converting completely residual oxygen to moisture, prior to introducing into the heating zone of the furnace (location 76 in FIG. 1) through a diffuser. A generally cylindrical shaped diffuser (FIG. 3C of the patent application referred to above) comprising a top half of ¾ in. diameter, 6 in. long porous Inconel material with a total of 96, ⅛ in. diameter holes was assembled. The size and number of holes in the diffuser were selected in a way that it provided uniform flow of gas through each hole. The bottom half of the diffuser was a gas impervious Inconel with one end of the diffuser capped and the other end attached to a ½ in. diameter stainless steel feed tube inserted into the furnace 60 through the cooling end vestibule 68. The bottom half of diffuser was positioned parallel to the parts 16' being treated thus essentially directing the flow of feed gas towards the hot ceiling of the furnace. The diffuser therefore helped in preventing the direct impingement of feed gas on the parts.

The analysis of gas samples taken from the heating and cooling zones showed almost complete conversion of residual oxygen to moisture. The ratio of $pH_2/pH_2O$ in the atmosphere in the heating and cooling zones of the furnace was less than 2, which is desirable for oxide annealing carbon steels. The samples treated in this example were annealed with a uniform tightly packed oxide layer, as shown in Table 1. This example showed that carbon steel samples can be oxide annealed at 750° C. in non-cryogenically produced nitrogen that has been premixed with more than stoichiometric amount of hydrogen and introduced into the heating zone of a furnace through a diffuser.

EXAMPLE 1B

The carbon steel annealing experiment described in Example 1A was repeated using similar furnace, annealing temperature, flow rate of gases with the exception of using 1.5% hydrogen, as shown in Table 1. The amount of hydrogen used was 1.5 times the stoichiometric amount required for converting residual oxygen completely to moisture. The ratio of $pH_2/pH_2O$ in the atmosphere in the heating and cooling zones of the furnace was less than 2. The samples treated in this example were annealed with a uniform tightly packed oxide layer, as shown in Table 1. This example showed that carbon steel samples can be oxide annealed in non-cryogenically produced nitrogen that has been premixed with more than stoichiometric amount of hydrogen and introduced into the heating zone of a furnace through a diffuser.

EXAMPLES 1C and 1D

The carbon steel annealing experiment described in Example 1A was repeated two times using similar furnace, annealing temperature, flow rate of gases with the exception of using 3% and 5% hydrogen, as shown in Table 1. The amount of hydrogen used in these examples was 3 and 5 times the stoichiometric amount required for converting residual oxygen completely to moisture.

The analysis of gas samples taken from the heating and cooling zones showed almost complete conversion of residual oxygen to moisture. The ratio of $pH_2/pH_2O$ in the atmosphere in the heating and cooling zones in these examples was close to 2 and 4. The samples treated in these examples were annealed with a uniform shiny bright surface finish (see Table 1) and produced decarburization of approximately 0.005 inches.

These examples showed that carbon steel samples can be decarburize, bright annealed in non-cryogenically generated nitrogen that has been introduced into the heating zone of a furnace through a diffuser and premixed with enough amount of hydrogen to provide $pH_2/pH_2O$ ratio of at least 2 in the furnace atmosphere.

EXAMPLE 1E

The carbon steel annealing experiment described in Example 1A was repeated using the similar furnace, composition and flow rate of gases with the exception of using 950° C. annealing temperature, as shown in Table 1. The amount of hydrogen used was 1.2 times the stoichiometric amount required for converting residual oxygen completely to moisture. The ratio of $pH_2/pH_2O$ in the atmosphere in the heating and cooling zones of the furnace was less than 2. The samples treated in this example were annealed with a uniform tightly packed oxide layer, as shown in Table 1. This example showed that carbon steel samples can be oxide annealed in non-cryogenically produced nitrogen that has been premixed with more than stoichiometric amount of hydrogen and introduced into the heating zone of a furnace through a diffuser.

EXAMPLE 1F

The carbon steel annealing experiment described in Example 1C was repeated using similar furnace, composition and flow rate of gases with the exception of using 950° C. temperature, as shown in Table 1. The amount of hydrogen used in this example was 3 times the stoichiometric amount required for converting residual oxygen completely to moisture.

The analysis of gas samples taken from the heating and cooling zones showed almost complete conversion of residual oxygen to moisture. The ratio of $pH_2/pH_2O$ in the atmosphere in the heating and cooling zones in this example was 2. The samples treated in this example were annealed with a uniform shiny bright surface finish, as shown in Table 1. The annealed samples showed decarburization of approximately 0.0065 inches. This example showed that carbon steel samples can be decarburize, bright annealed in non-cryogenically generated nitrogen that has been introduced into the heating zone of a furnace through a diffuser and premixed with enough amount of hydrogen to provide $pH_2/pH_2O$ ratio of at least 2 in the furnace atmosphere.

The above examples show that the residual oxygen present in the feed nitrogen can be converted completely to moisture provided that the feed gas is mixed with more than stoichiometric amount of hydrogen and that it is introduced into the heating zone of a furnace operating above about 600° C. through a diffuser. These examples also show that carbon steels can be oxide annealed in non-cryogenically produced nitrogen provided it is mixed with enough amount of hydrogen to provide $pH_2/pH_2O$ ratio of less than 2 in the furnace atmosphere. Finally, these examples show that non-cryogenically produced nitrogen can be used to decarburize, bright anneal carbon steels provided it is mixed with enough amount of hydrogen to provide $pH_2/pH_2O$ ratio of at least 2 in the furnace.

Table 2 and the following discussion sets forth experimental results of processes practiced according to the present invention.

TABLE 2

| | Example 2A | Example 2B | Example 2C | Example 2D | Example 2E | Example 2F |
|---|---|---|---|---|---|---|
| Type of Samples | Carbon Steel | Carbon Steel | Carbon Steel | Carbon Steel | Carbon Steel | Carbon Steel |
| Heat Treating Temperature, °C. | 700 | 700 | 700 | 700 | 800 | 800 |
| Flow Rate of Feed Gas, SCFH | 350 | 350 | 350 | 350 | 350 | 350 |
| Feed Gas Location | Heating Zone | Heating Zone | Heating Zone | Heating Zone | Heating Zone | Heating Zone |
| Type of Feed Device | Modified Diffuser | Modified Diffuser | Modified Diffuser | Modified Diffuser | Modified Diffuser | Modified Diffuser |
| Feed Gas Composition | | | | | | |
| Nitrogen, % | 99.5 | 99.5 | 99.5 | 99.5 | 99.5 | 99.5 |
| Oxygen, % | 0.5 | 0.5 | 0.5 | 0.5 | 0.5 | 0.5 |
| Moisture, % | 2.0 | 2.0 | 2.0 | 2.0 | 2.0 | 2.0 |
| Hydrogen*, % | 1.2 | 3.0 | 6.0 | 10.0 | 1.2 | 3.0 |
| Heating Zone Atmosphere Composition | | | | | | |
| Oxygen, ppm | <5 | <5 | <6 | <4 | <4 | <4 |
| Hydrogen, % | 0.2 | 2.0 | 5.0 | 9.0 | 0.2 | 2.0 |
| Moisture, % | 3.0 | 3.0 | 3.0 | 3.0 | 3.0 | 3.0 |
| Cooling Zone Atmosphere Composition | | | | | | |
| Oxygen, ppm | <3 | <3 | <5 | <3 | <3 | <3 |
| Hydrogen, % | 0.2 | 2.0 | 5.0 | 9.0 | 0.2 | 2.0 |
| Moisture, % | 3.0 | 3.0 | 3.0 | 3.0 | 3.0 | 3.0 |
| $pH_2/pH_2O$ Ratio in the Furnace | 0.07 | 0.67 | 1.67 | 3.0 | 0.07 | 0.67 |
| Quality of Heat Treated Sample | Uniform Tightly Packed Oxide | Uniform Tightly Packed Oxide | Uniform Tightly Packed Oxide | Uniform Shiny Bright | Uniform Tightly Packed Oxide | Uniform Tightly Packed Oxide |

| | Example 2G | Example 2H | Example 2I | Example 2J | Example 2K |
|---|---|---|---|---|---|
| Type of Samples | Carbon Steel | Carbon Steel | Carbon Steel | Carbon Steel | Carbon Steel |
| Heat Treating Temperature, °C. | 800 | 850 | 900 | 900 | 800 |
| Flow Rate of Feed Gas, SCFH | 350 | 350 | 350 | 350 | 350 |
| Feed Gas Location | Heating Zone | Heating Zone | Heating Zone | Heating Zone | Heating Zone |
| Type of Feed Device | Modified Diffuser | Modified Diffuser | Modified Diffuser | Modified Diffuser | Modified Diffuser |
| Feed Gas Composition | | | | | |
| Nitrogen, % | 99.5 | 99.5 | 99.5 | 99.5 | 99.5 |
| Oxygen, % | 0.5 | 0.5 | 0.5 | 0.5 | 0.5 |
| Moisture, % | 2.0 | 2.0 | 2.0 | 2.0 | 2.0 |
| Hydrogen*, % | 6.0 | 10.0 | 1.2 | 3.0 | 10.0 |
| Heating Zone Atmosphere Composition | | | | | |
| Oxygen, ppm | <4 | <3 | <4 | <3 | <3 |
| Hydrogen, % | 5.0 | 9.0 | 0.2 | 2.0 | 9.0 |
| Moisture, % | 3.0 | 3.0 | 3.0 | 3.0 | 3.0 |
| Cooling Zone Atmosphere Composition | | | | | |
| Oxygen, ppm | <3 | <3 | <4 | <2 | <4 |
| Hydrogen, % | 5.0 | 9.0 | 0.2 | 2.0 | 9.0 |
| Moisture, % | 3.0 | 3.0 | 3.0 | 3.0 | 3.0 |
| $pH_2/pH_2O$ Ratio in the Furnace | 1.67 | 3.0 | 0.07 | 0.67 | 3.0 |
| Quality of Heat Treated Sample | Uniform Tightly | Uniform Shiny | Uniform Tightly | Uniform Tightly | Uniform Shiny |

TABLE 2-continued

| | | | | |
|---|---|---|---|---|
| Packed Oxide | Bright | Packed Oxide | Packed Oxide | Bright |

*Hydrogen gas was mixed with nitrogen and added as a percent of total non-cryogenically produced feed nitrogen.

EXAMPLES 2A to 2C

Oxide Annealing

The carbon steel annealing experiment described in Example 1A was repeated three times using similar furnace, flow rate of non-cryogenically generated nitrogen with the exceptions of using 700° C. annealing temperature and 1.2, 3.0, and 6.0% hydrogen, respectively (see Table 2). The amount of hydrogen used in these examples was 1.2, 3.0 and 6.0 times the stoichiometric amount required for converting residual oxygen completely to moisture. The non-cryogenically generated nitrogen gas was humidified with 2.0% moisture prior to introducing it into the heating zone of the furnace in these examples.

The analysis of gas samples taken from the heating and cooling zones showed almost complete conversion of residual oxygen to moisture. The ratio of $pH_2/pH_2O$ in the atmosphere in the heating and cooling zones in these examples was less than 2. The samples treated in these examples were annealed with a uniform tightly packed oxide layer, as shown in Table 2. These examples showed that carbon steel samples can be oxide annealed in humidified non-cryogenically produced nitrogen that has been premixed with enough amount of hydrogen to provide a $pH_2/pH_2O$ ratio of less than 2 in the furnace atmosphere and that is introduced into the heating zone of a furnace through a diffuser.

EXAMPLE 2D

Decarburize, Bright Annealing

The carbon steel annealing experiments described in Examples 2A to 2C was repeated using similar furnace, annealing temperature, flow rate of gases with the exception of using 10% hydrogen, as shown in Table 2. The amount of hydrogen used was 10.0 times the stoichiometric amount required for converting residual oxygen completely to moisture. The non-cryogenically generated nitrogen gas was humidified with 2.0% moisture prior to introducing it into the heating zone of the furnace in this example.

The analysis of gas samples taken from the heating and cooling zones showed almost complete conversion of residual oxygen to moisture. The ratio of $pH_2/pH_2O$ in the atmosphere in the heating and cooling zones was more than 2. The samples treated in this example were annealed with a uniform bright surface finish, as shown in Table 2. The steel samples annealed in this example produced decarburization of approximately 0.005 inches. This example showed that carbon steel samples can be decarburize, bright annealed in humidified non-cryogenically produced nitrogen that has been premixed enough amount of hydrogen to provide a $pH_2/pH_2O$ ratio at least 2.0 in the furnace and that the gaseous feed mixture is introduced into the heating zone of a furnace through a diffuser.

EXAMPLES 2E to 2G

Oxide Annealing

The carbon steel annealing experiments described in Example 2A to 2C were repeated using similar furnace, composition and flow rate of non-cryogenically produced nitrogen, and the amount of hydrogen added with the exception of using 800° C. annealing temperature, as shown in Table 2. The amount of hydrogen used in these examples was 1.2, 3.0 and 6.0 times the stoichiometric amount required for converting residual oxygen completely to moisture. The non-cryogenically generated nitrogen gas was humidified with 2.0% moisture prior to introducing it into the heating zone of the furnace in these examples.

The samples treated in these examples were annealed with a uniform tightly packed oxide layer, as shown in Table 2. The samples were oxide annealed because of low $pH_2/pH_2O$ ratio (less than 2) in the furnace atmosphere. These examples showed that carbon steel samples can be oxide annealed in humidified non-cryogenically produced nitrogen that has been premixed with enough amount of hydrogen to provide a $pH_2/pH_2O$ ratio of less than 2 in the furnace atmosphere and that is introduced into the heating zone of a furnace through a diffuser.

EXAMPLE 2H

Decarburize, Bright Annealing

The carbon steel annealing experiment described in Example 2D was repeated using similar furnace, composition and flow rate of gases, amount of hydrogen gas with the exception of using 800° C. annealing temperature, as shown in Table 2. The amount of hydrogen used was 10.0 times the stoichiometric amount required for converting residual oxygen completely to moisture. The non-cryogenically generated nitrogen gas was humidified with 2.0% moisture prior to introducing it into the heating zone of the furnace in this example.

The samples treated in this example were annealed with a uniform bright surface finish, as shown in Table 2. The samples were bright annealed because of the presence of a $pH_2/pH_2O$ ratio more than 2 in the furnace atmosphere. The steel samples annealed in this example produced decarburization of approximately 0.007 inches. This example showed that carbon steel samples can be decarburize, bright annealed in humidified non-cryogenically produced nitrogen that has been premixed enough amount of hydrogen to provide a $pH_2/pH_2O$ ratio of at least 2.0 in the furnace atmosphere and that the gaseous feed mixture is introduced into the heating zone of a furnace through a diffuser.

EXAMPLES 2I and 2J

Oxide Annealing

The carbon steel annealing experiments described in Example 2A and 2B were repeated using similar furnace, composition and flow rate of non-cryogenically produced nitrogen, amount of hydrogen added, with the exception of using 900° C. annealing temperature, as shown in Table 2. The amount of hydrogen used in these examples was 1.2 and 3.0 times the stoichiometric amount required for converting residual oxygen completely to moisture. The non-cryogenically generated nitrogen gas was humidified with 2.0% moisture prior to introducing it into the heating zone of the furnace in these examples.

The samples treated in these examples were annealed with a uniform tightly packed oxide layer, as shown in Table 2. The samples were oxide annealed because of low $pH_2/pH_2O$ ratio (less than 2) in the furnace atmosphere. These examples showed that carbon steel samples can be oxide annealed in humidified non-cryogenically produced nitrogen that has been premixed with enough amount of hydrogen to provide a $pH_2/pH_2O$ ratio of less than 2 in the furnace atmosphere and that is introduced into the heating zone of a furnace through a diffuser.

EXAMPLE 2K

Decarburize, Bright Annealing

The carbon steel annealing experiment described in Example 2D was repeated using similar furnace, composition and flow rate of gases, amount of hydrogen gas with the exception of using 900° C. annealing temperature, as shown in Table 2. The amount of hydrogen used was 10.0 times the stoichiometric amount required for converting residual oxygen completely to moisture. The non-cryogenically generated nitrogen gas was humidified with 2.0% moisture prior to introducing it into the heating zone of the furnace in this example.

The samples treated in this example were annealed with a uniform bright surface finish, as shown in Table 2. The samples were bright annealed because of a $pH_2/pH_2O$ ratio of more than 2 in the furnace atmosphere. The steel samples annealed in this example produced decarburization of approximately 0.008 inches. This example showed that carbon steel samples can be decarburize, bright annealed in humidified non-cryogenically produced nitrogen that has been premixed enough amount of hydrogen to provide $pH_2/pH_2O$ ratio of at least 2.0 in the furnace atmosphere and that the gaseous feed mixture is introduced into the heating zone of a furnace through a diffuser.

The above examples 2A to 2K show that the residual oxygen present in the feed nitrogen can be converted completely to moisture provided that the feed gas is mixed with more than stoichiometric amount of hydrogen and that it is introduced into the heating zone of a furnace operating above about 600° C. through a diffuser. These examples also show that carbon steel can be oxide annealed in humidified non-cryogenically generated nitrogen provided it is mixed enough amount of hydrogen to provide a $pH_2/pH_2O$ ratio of less than 2 in the furnace atmosphere. Finally, these examples show that humidified non-cryogenically produced nitrogen can be used to decarburize, bright anneal carbon steels provided it is mixed with enough amount of hydrogen to provide $pH_2/pH_2O$ ratio of at least 2 in the furnace atmosphere.

A continuous roller hearth furnace equipped with heating and cooling zones was used to decarburize, oxide anneal low carbon steel samples in non-cryogenically generated (Pressure Swing Adsorption, PSA) nitrogen. The furnace was 45 inches wide. The heating zone of the furnace was 30 inches high and 20 feet long and the cooling zone was 20 inches high and 30 feet long. The non-cryogenically generated or PSA nitrogen stream was divided into two flow streams. One of the flow streams was humidified by passing through a heated water column or bubbler. The other flow stream was blended with a specified amount of hydrogen gas. These two flow streams, one humidified and the other blended with hydrogen, were combined and then divided equally into three streams to introduce them into the heating zone of the continuous roller hearth furnace through three concentric diffusers similar in design shown in FIG. 3G of the aforementioned patent application.

The diffusers were made of Inconel 601 material. The inside diameter of the delivery tube of the diffusers was 0.5 inch and the outside diameter of the outer concentric tube was 1 inch. The length of the porous section in the delivery tube was approximately 1 inch. The porous section contained approximately 40 holes with ⅛ inch in diameter. The porous section in the larger concentric cylinder was also 1 inch long. It contained 54 holes with ⅛ in diameter to distribute feed gas in the heating zone of the furnace. The total length of the larger concentric cylinder was about 3 inches. The diffusers were placed in the heating zone of the furnace through a refractory wall in such a way that only the 3 inch long section of the diffuser (larger concentric cylinder) was extending inside the furnace.

EXAMPLE 3A

Decarburize, Oxide Annealing

Samples of low-carbon electrical steel which were delubed prior to annealing were decarburize, oxide annealed at 780° C. in a roller hearth furnace described above using a total 3500 SCFH flow of PSA nitrogen containing 99.65% nitrogen and 0.35% residual oxygen. The PSA nitrogen stream, as mentioned above, was divided into two streams. One stream or 2700 SCFH of PSA nitrogen was humidified and the remaining 750 SCFH of PSA nitrogen stream was blended with hydrogen. These two streams were then combined and the combined stream contained 1.1% moisture and 6.7% hydrogen. The amount of hydrogen therefore was 9.6 times the stoichiometric amount required to convert the residual oxygen present in the PSA stream completely to moisture. The combined stream was divided equally into three streams and introduced into the heating zone of the furnace through three diffusers similar to the one described above.

The analysis of gas samples taken from the heating and cooling zones of the furnace showed almost complete conversion of residual oxygen to moisture. The furnace atmosphere contained 1.8% moisture or +60° C. dew point and 6% hydrogen. The ratio of $pH_2/pH_2O$ in the atmosphere in the heating and cooling zones of the furnace was greater than 2. The samples treated in this example were decarburize annealed with a uniform tightly packed oxide surface finish. The samples were decarburized due to high moisture content in the furnace. They had an uniform surface oxide finish due to 1) oxidation caused by slow cooling in the cooling zone and 2) oxidation caused by the ambient environment by discharging samples at approximately 350° C. temperature.

This example showed that carbon steel samples can be decarburize annealed in humidified non-cryogenically produced nitrogen that has been pre-mixed with enough amount of hydrogen to provide a $pH_2/pH_2O$ ratio of greater than 2 in the furnace atmosphere and that is introduced into the heating zone of a furnace through diffusers. It also showed that the decarburized samples can be oxidized uniformly by discharging them from the cooling zone of the furnace at an elevated temperature.

EXAMPLE 3B

Decarburize, Oxide Annealing

The electrical steel annealing experiment described in Example 3A was repeated using similar furnace, diffusers, annealing temperature, and flow rate of non-cryogenically generated (PSA) nitrogen with the exceptions of using PSA nitrogen containing 99.50% nitrogen and 0.5% residual oxygen and the combined stream containing 7.15% hydrogen and 1.25% moisture. The amount of hydrogen was 7.15 times the stoichiometric amount required to convert the residual oxygen present in the PSA stream completely to moisture. The combined stream was divided equally into three streams and introduced into the heating zone of the furnace through three diffusers.

The analysis of gas samples taken from the heating and cooling zones of the furnace showed almost complete conversion of residual oxygen to moisture. The furnace atmosphere contained 2.25% moisture and 6.15% hydrogen. The ratio of $pH_2/pH_2O$ in the atmosphere in the heating and cooling zones of the furnace was greater than 2. The samples treated in this example were decarburize annealed with a uniform tightly packed oxide surface finish. The samples were decarburized due to high moisture content in the furnace. They had an uniform surface oxide finish due to 1) oxidation caused by slow cooling in the cooling zone and 2) oxidation caused by the ambient environment by discharging samples at approximately 350° C. temperature.

This example showed that carbon steel samples can be decarburize annealed in humidified non-cryogenically produced nitrogen that has been pre-mixed with enough amount of hydrogen to provide a $pH_2/pH_2O$ ratio of greater than 2 in the furnace atmosphere and that is introduced into the heating zone of a furnace through diffusers. It also showed that the decarburized samples can be oxidized uniformly by discharging them from the cooling zone of the furnace at an elevated temperature.

EXAMPLE 3C

Decarburize, Oxide Annealing

The electrical steel annealing experiment described in Example 3B was repeated using similar furnace, diffusers, annealing temperature, composition and flow rate of non-cryogenically generated (PSA) nitrogen, and the amount of added hydrogen and moisture with the exception of adding steam in the cooling zone to oxidize annealed samples.

The analysis of gas samples taken from the heating zone of the furnace showed almost complete conversion of residual oxygen to moisture. The furnace atmosphere in the heating zone contained 2.25% moisture and 6.15% hydrogen. The ratio of $pH_2/pH_2O$ in the atmosphere in the heating zone of the furnace was greater than 2. However, the ratio of $pH_2/pH_2O$ in the atmosphere in the cooling zone of the furnace was less than 2. The samples treated in this example were decarburize annealed with a uniform tightly packed oxide surface finish. The samples were decarburized due to high moisture content in the furnace. They had a uniform surface oxide finish due to oxidation caused by low $pH_2/pH_2O$ ratio (less than 2) in the atmosphere in the cooling zone of the furnace.

This example showed that carbon steel samples can be decarburize annealed in humidified non-cryogenically produced nitrogen that has been pre-mixed with enough amount of hydrogen to provide a $pH_2/pH_2O$ ratio of greater than 2 in the atmosphere in the heating zone of the furnace and that is introduced into the heating zone of a furnace through diffusers. It also showed that the decarburized samples can be oxidized uniformly in the atmosphere in the cooling zone by maintaining low $pH_2/pH_2O$ ratio (less than 2) in the cooling zone of the furnace.

Having thus described our invention, what is desired to be secured by Letters Patent of the United States is set forth in the appended claims we claim:

1. A process for oxide annealing carbon steel in a nitrogen-based furnace atmosphere containing X percent by volume moisture comprising the steps of:

mixing non-cryogenically produced nitrogen containing up to Y% by volume residual oxygen with slightly more than 2Y% by volume by hydrogen;

humidifying the mixture with a volume percent of moisture calculated as $X-2Y$; and feeding the humidified mixture into the heating zone of the furnace in a direction to permit reaction of the residual oxygen and hydrogen in the mixture prior to oxygen contacting the steel being treated so that an atmosphere with a $pH_2/pH_2O$ ratio of less than 2 is created in the furnace.

2. A process according to claim 1 wherein the furnace is heated to a temperature of between 600° and 950° C.

3. A process for decarburizing, bright annealing carbon steel in a nitrogen based furnace atmosphere containing X percent by volume moisture comprising the steps of:

mixing non-cryogenically produced nitrogen containing up to Y% by volume residual oxygen with slightly more than $2X+2Y$ percent by volume hydrogen;

humidifying the mixture with $X-2Y$ percent by volume moisture; and feeding the humidified mixture into the heating zone of the furnace in a direction to permit reaction of the residual oxygen and hydrogen in the mixture prior to oxygen contacting the steel being treated so that an atmosphere with a $pH_2/pH_2O$ ratio of at least 2 is created in the furnace.

4. A process according to claim 3 wherein the furnace heat zone is heated to a temperature between 600° and 950° C.

5. A process for decarburizing, oxide annealing carbon steel in a furnace having heating and cooling zones in a nitrogen based furnace atmosphere containing X percent by volume moisture comprising the steps of:

mixing nitrogen containing Y percent by volume residual oxygen with slightly more than $2X+2Y$ percent by volume hydrogen;

humidifying the mixture with $X-2Y$ percent by volume moisture by injecting steam at a temperature less than 550° C. into the cooling zone of the furnace; and feeding said humidified mixture into the heating zone of a furnace in a manner to cause reaction of the hydrogen and oxygen in the mixture before the oxygen contacts the steel being treated so that an atmosphere with a $pH_2/pH_2O$ ratio of at least 2 is created in the heating zone of the furnace.

6. A process according to claim 5 wherein the heat zone of the furnace is maintained at a temperature in excess of 150° C.

7. A process for decarburizing, oxide annealing carbon steel in a furnace having heating and cooling zones in a nitrogen based furnace atmosphere containing X percent by volume moisture comprising the steps of:

mixing nitrogen containing Y percent by volume residual oxygen with slightly more than 2X+2Y percent by volume hydrogen;

humidifying the mixture with X−2Y percent by volume moisture;

feeding said humidified mixture into the heating zone of a furnace in a manner to cause reaction of the hydrogen and oxygen in the mixture before the oxygen contacts the steel being treated so that an atmosphere with a $pH_2/pH_2O$ ratio of at least 2 is created in the furnace; and discharging steel being treated at a temperature below 400° C. from said cooling zone into ambient atmosphere.

8. A process according to claim 7 wherein the nitrogen in the atmosphere is non-cryogenically produced nitrogen.

9. A process according to claim 7 wherein the heat zone of the furnace is heated to a temperature of between 600° and 950° C.

* * * * *